US011988068B1

(12) United States Patent
Song et al.

(10) Patent No.: US 11,988,068 B1
(45) Date of Patent: May 21, 2024

(54) STAGED MULTI-CLUSTER FRACTURING SLIDING SLEEVE SYSTEM BASED ON SMART KEY LABEL

(71) Applicant: Ningbo Huaao intelligent equipment Co., LTD, Yuyao (CN)

(72) Inventors: Wenping Song, Harbin (CN); Jiuzheng Yu, Harbin (CN); Qiao Sun, Harbin (CN); Duoli Zhang, Harbin (CN); Tao Ma, Harbin (CN); Jiaqing Zhang, Harbin (CN); Hao Yu, Harbin (CN); Pengyu Li, Harbin (CN); Wei Liu, Harbin (CN)

( * ) Notice: Subject to any disclaimer, the term of this patent is extended or adjusted under 35 U.S.C. 154(b) by 0 days.

(21) Appl. No.: 18/384,832

(22) Filed: Oct. 27, 2023

Related U.S. Application Data

(63) Continuation of application No. PCT/CN2023/090716, filed on Apr. 26, 2023.

(30) Foreign Application Priority Data

Dec. 23, 2022 (CN) ..... 202211680856.9

(51) Int. Cl.
*E21B 23/04* (2006.01)
*E21B 34/14* (2006.01)
*E21B 43/26* (2006.01)

(52) U.S. Cl.
CPC ..... *E21B 34/14* (2013.01); *E21B 43/26* (2013.01); *E21B 23/04* (2013.01)

(58) Field of Classification Search
CPC .... E21B 34/063; E21B 34/066; E21B 34/142; E21B 2200/08; E21B 23/0413;
(Continued)

(56) References Cited

U.S. PATENT DOCUMENTS 9,683,419 B2 * 6/2017 Coon ..... E21B 47/09
11,215,020 B2 * 1/2022 Watkins ..... E21B 34/10
(Continued)

FOREIGN PATENT DOCUMENTS

CN 106677755 A 4/2018
CN 213331024 A 6/2021
CN 113356794 A 12/2021

*Primary Examiner* — Kenneth L Thompson
(74) *Attorney, Agent, or Firm* — Daniel M. Cohn; Howard M. Cohn

(57) ABSTRACT

The invention relates to the technical field of oil and gas field development, in particular to a staged multi-cluster fracturing sliding sleeve system and method based on smart key label. The system includes at least one multi-cluster sliding correspondingly placed in each fracturing stage, an end sliding sleeve, and a smart key label. The method includes: step S1, performing fracturing stage by stage from a first stage to a last stage, placing the smart key label through a wellhead and pumping the smart key label to the target fracturing stage; step S2, opening the multi-cluster sliding sleeves of the current fracturing stage one by one through the smart key label, and finally blocking the smart key label in the end sliding sleeve when the multi-cluster sliding sleeve and the end sliding sleeve of the current fracturing stage are opened; and step S3, repeating the steps S1 and S2 until the fracturing operations of all the stages are completed.

10 Claims, 7 Drawing Sheets

(58) Field of Classification Search
CPC .. E21B 2200/06; E21B 33/1294; E21B 43/26; E21B 43/162
See application file for complete search history.

(56) References Cited

U.S. PATENT DOCUMENTS

| | | | | |
|---|---|---|---|---|
| 11,391,138 | B2 * | 7/2022 | Winkler | E21B 33/134 |
| 11,555,378 | B2 * | 1/2023 | Romer | E21B 33/128 |
| 11,808,145 | B2 * | 11/2023 | Fripp | E21B 43/261 |
| 11,828,149 | B1 * | 11/2023 | Tian | E21B 34/14 |
| 2021/0156211 | A1 * | 5/2021 | Arabskyy | E21B 43/14 |
| 2023/0137410 | A1 * | 5/2023 | Xu | E21B 34/14 166/386 |
| 2023/0340846 | A1 * | 10/2023 | Jacob | E21B 23/04 |

* cited by examiner

Viewed from
direction M

STAGED MULTI-CLUSTER FRACTURING SLIDING SLEEVE SYSTEM BASED ON SMART KEY LABEL

FIELD

The invention relates to the technical field of oil and gas field development, in particular to a staged multi-cluster fracturing sliding sleeve system and method based on smart key label.

BACKGROUND

At present, with the ball or mechanical screw or dart sliding sleeve used in the completion fracturing of oil and gas fields at home and abroad, the staged fracturing of a certain number of stages and the fracturing of a certain number of clusters within each stage can be realized. However, due to the limitation of structural principle of these sliding sleeves, the full-bore indefinite-level staged fracturing cannot be realized. For example, in the ball sliding sleeve, a diameter of the sliding sleeve needs to decrease level by level to engage with the balls of different diameters to open the sliding sleeve, resulting in a limited number of fracturing stages and a limited fracturing displacement. In the mechanical screw or dart sliding sleeve, although the diameters of the sliding sleeves within a certain number of stages can be identical, the sliding sleeve can be opened only when the size of each screw or dart is fully matched with an internal slot of the sliding sleeve of each stage (each cluster). However, construction operations such as casing cementing inevitably lead to changes in the shape of the internal slot of the sliding sleeve, which seriously affects the matching degree between the screw or dart and the internal slot of the sliding sleeve and thus leads to the low success rate of opening the sliding sleeve. In addition, the size specifications of each sliding sleeve and screw need to be different from each other, and the sliding sleeve and screw need to be inserted one by one during construction; furthermore, the number of fracturing stages is limited due to the arrangement and combination principle.

SUMMARY

Therefore, the present disclosure provides a staged multi-cluster fracturing sliding sleeve system based on smart key label and an implementation method thereof, being capable of opening multiple sliding sleeves in a single fracturing stage through a smart key label without decreasing a diameter of the sliding sleeve level by level.

In a first aspect of the present disclosure, a smart key label Is provided, including a sliding push sleeve, a cone guide body connected with the sliding push sleeve through an actuator, a sealing ring mounted on a right end of the sliding push sleeve, and an inner end surface of the sealing ring is attached to an outer end surface of the cone guide body; the actuator is connected with the sliding push sleeve through a thread, and a blocking portion is connected to an internal right end of the cone guide body; the cone guide body, the blocking portion and the actuator form a sealing cavity; a position detection sensor, a control circuit board and a high temperature battery are arranged in the sealing cavity and are connected by a wire; the actuator is capable of driving the sliding push sleeve to move relative to the cone guide body; the sliding push sleeve drives the sealing ring to move relative to the cone guide body to expand or contract the sealing ring;

a flowback channel is formed in a left part of the sliding push sleeve and a soluble ball is arranged on a left end of the flowback channel, which is capable of blocking a left part of the flowback channel.

In an embodiment, an outer diameter of the sealing ring in the minimum state is not greater than an overall outer diameter of the smart key label.

In an embodiment, a left end of the sliding push sleeve is provided with a chamfer surface being connected with the flowback channel.

In a second aspect of the present disclosure, a multi-cluster sliding sleeve used with the above smart key label is provided, including a first housing part with a first magnetic field formed therein, and a first valve body part, and an annular groove formed in an inner wall of the housing part I, the first housing part being integrally formed or separately formed, and the position detection sensor being capable of detecting the first magnetic field;

wherein the first valve body part is provided with a clamping structure for clamping the sealing ring; the clamping structure includes a protrusion protruding from an inner wall of the first valve body part, and the clamping structure can enter the annular slot such that the protrusion is separated from an inner side of the inner wall of the first valve body part.

In an embodiment, the clamping structure includes at least one axial slot evenly formed in a right end of the first valve body part along a circumferential direction; a right end of the axial slot forms an opening, such that the at least one evenly-arranged axial slot form an incomplete annular structure; an inner wall of the right end of the first valve body part is provided with an inclined surface with an inner diameter thereof increasing from left to right to form the protrusion, the protrusion is configured to clamp the sealing ring; when the protrusion expands into the annular slot, the sealing ring can pass through the protrusion.

In an embodiment, the clamping structure is a transmission pin, and the transmission pin is a cylindrical structure with a convex ball head.

In an embodiment, a plurality of the transmission pins are evenly arranged along a circumferential direction.

In a third aspect of the present disclosure, an end sliding sleeve used with the above multi-cluster sliding sleeve is provided, including a second housing part with a second magnetic field formed therein, and the position detection sensor being capable of detecting the second magnetic field;

wherein the end sliding sleeve further includes a second valve body part, and a right side of the second valve body part is provided with a protrusion clamping with the sealing ring; and a left part of the protrusion is a sawtooth structure arranged along a circumferential direction.

In a fourth aspect of the present disclosure, a staged multi-cluster fracturing sliding sleeve system based on smart key label is provided, wherein the stage multi-cluster fracturing sliding sleeve system includes at least one multi-cluster sliding correspondingly placed in each fracturing stage, an end sliding sleeve placed at an end of the fracturing stage, and a smart key label which is pumped to a target fracturing stage.

In a fifth aspect of the present disclosure, an implementation method of the above stage multi-cluster fracturing sliding sleeve system based on smart key label is provided, including:

step S1, performing fracturing stage by stage from a first stage to a last stage, placing the smart key label through a wellhead and pumping the smart key label to the target fracturing stage;

step S2, opening the multi-cluster sliding sleeves of the current fracturing stage one by one through the smart key label, and finally blocking the smart key label in the end sliding sleeve when the multi-cluster sliding sleeve and the end sliding sleeve of the current fracturing stage are opened; and step S3, repeating the steps S1 and S2 until the fracturing operations of all the stages are completed.

With multiple smart key labels of identical shapes and sizes as the opening tool of the sliding sleeve, an initial outer diameter of each smart key label is less than an inner diameter of the downhole casing and the sliding sleeve, and the smart key label in the initial state can pass through any sliding sleeve of any downhole fracturing stage freely. When a sliding sleeve needs to be opened, the position detection sensor of the smart key label can automatically detect and identify the magnet installed in the sliding sleeve. According to a target opening address set for the smart key label before entering the well, the actuator in the smart key label is automatically triggered to drive the metal sealing ring to expand circumferentially, such that the outer diameter of the sealing ring is greater than that of the sliding sleeve and thus the sealing ring is clamped in the sliding sleeve to open the target sliding sleeve as the pressure from the pump truck increases. Accordingly, with the smart key labels having identical outer diameters as the opening tool, inner diameters of the sliding sleeves of each cluster in each stage can be identical with each other. When the inner diameters of all sliding sleeves are identical with each other and can be exactly the same as the inner diameter of the casing, the staged full-bore indefinite-level multi-cluster fracturing of unlimited fracturing stages and unlimited displacement can be realized, which maximizes the scale of oil reservoir development. In addition, the sliding sleeve can be opened only when the sealing ring of the smart key label is clamped in the protrusion of the sliding sleeve, avoiding the adverse influence on the opening of the sliding sleeve caused by cementing and ensuring the reliability and success rate of the opening of the sliding sleeve.

The advantages of the staged multi-cluster fracturing sliding sleeve system and the implementation method based on smart key label are as follows.

Firstly, with the smart key labels of identical shapes and sizes and of automagical identification and opening function as the opening tool of the sliding sleeve, the problem that the diameter of the conventional ball sliding sleeve needs to decrease level by level and the mechanical screw or dart specifications are inconsistent can be solved, the diameters of the down whole sliding sleeves of all the stages can be identical, and indefinite level and unlimited displacement can be achieved, which meets the applicability of ultra-deep wells, long horizontal sections and large-scale fracturing construction.

Secondly, with the combination of the full-bore multi-cluster sliding sleeve and the end sliding sleeve, not only can indefinite number of fracturing stages be realized, but also the indefinite number of clusters in each stage can be realized, thus, the inner diameters of all the sliding sleeves can be identical and the number of the sliding sleeves can be set according to requirements, which improves the flexibility of downhole fracturing.

Thirdly, when the minimum inner diameter of the sliding sleeve is identical with the inner diameter of the downhole casing, throttling and stagnation may not occur in the sliding sleeve, thus, the pipe strings and tools of the whole well can have an identical diameter, which ensures that the displacement of the pump truck may not be affected by the stage number of the sliding sleeve, and provides the maximum running space for the process pipe string in subsequent production.

Fourthly, the smart key label, the multi-cluster sliding sleeve, and the end sliding sleeve have the identical specification, thus, the multi-cluster sliding sleeves are interchangeable, the end sliding sleeves are interchangeable, greatly reducing the complexity of on-site construction supporting tools and the risk of error during construction work.

Fifthly, the smart key label and the sliding sleeve adopt non-contact wireless identification technology, which is not affected by the previous cementing and complex media in the well, thus, the smart key label can accurately and reliably identifies the target open sliding sleeve, and the smart key label can be accurately captured by the sliding sleeve, solving the problem that the full-bore sliding sleeve based on the mechanical screw or dart principle needs to have different structures level by level.

Sixthly, the smart key label has a completely-concentric fracturing fluid flowback channel. Through the cooperation between the flowback channel and the soluble ball, the one-way sealing from wellhead to downhole can be realized in the opening and fracturing construction of the sliding sleeve; when the fracturing construction is completed, the one-way communication from downhole to wellhead can be realized, to meet the needs of the pressure relief process after the fracturing construction.

BRIEF DESCRIPTION OF THE DRAWINGS

To describe the technical solutions in the embodiments of the present invention more clearly, the following briefly introduces the accompanying drawings required for describing the embodiments or the prior art. Apparently, the accompanying drawings in the following description show merely some embodiments of the present invention, and persons of ordinary skill in the art may still derive other drawings from these accompanying drawings without creative efforts.

DETAILED DESCRIPTION

Figure 1:
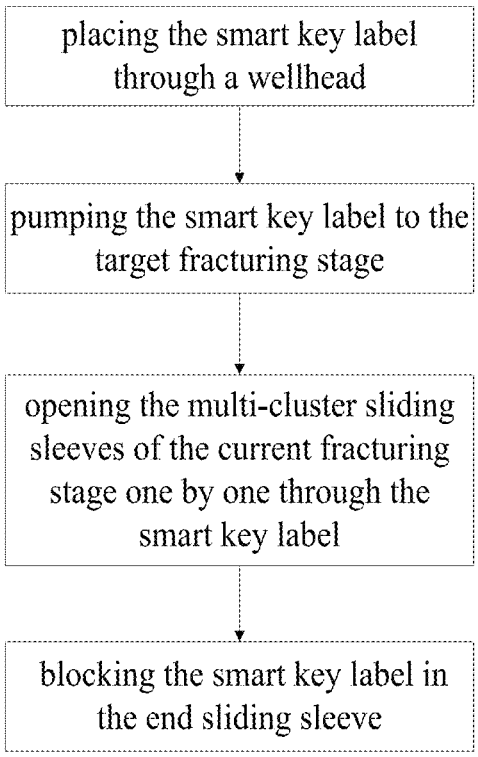
FIG. 1 is a flow chart of a process of opening a target stage of a staged multi-cluster fracturing sliding sleeve system based on smart key label.

The terms "first", "second", "third", "fourth", if any, in the specification and claims of the invention and in the drawings attached above are used to distinguish similar objects and need not be used to describe a particular order or sequence. It should be understood that the data thus used are interchangeable where appropriate so that the embodiments described here can be implemented in an order other than that illustrated or described here. Furthermore, the term "includes" or "has", and any variation thereof, is intended to cover non-exclusive inclusion. For example, a process, method, system, product or device comprising a series of steps or units need not be limited to those steps or units that are clearly listed. Instead, it may include other steps or units that are not clearly listed or are inherent to these processes, methods, products, or devices.

A staged multi-cluster fracturing sliding sleeve system based on smart key label includes a smart key label, an end sliding sleeve and a multi-cluster sliding sleeve. The end sliding sleeve and the multi-cluster sliding sleeve as a whole is referred as the sliding sleeve.

As shown in FIGS. 5 to 8, the smart key label includes a sliding push sleeve 101, a sealing ring 102, unloading grooves 102*a* evenly formed in a left end of the sealing ring 102 along a circumferential direction, a cone guide body 103, a blocking portion 104, a position detection sensor 105, a control circuit board 106, a high temperature battery 107, an actuator 108, a soluble ball 109, an overturning stopper 110, an overturning pin 111 and a torsion spring 112.

The sealing ring 102 is mounted on a right end of the sliding push sleeve 101. An outer diameter of the cone guide body 103 gradually increases from left to right and then gradually decreases. The sealing ring 102 contacts a cone surface of the cone guide body 103 through an inner hole thereof. The cone guide body 103 is relatively fixed to the sliding push sleeve 101 through the actuator 108. The actuator 108 is connected with the sliding push sleeve 101 through a thread. The actuator 108 is mounted on an inner left end of the cone guide body 103, and the blocking portion 104 is mounted on an inner right end of the cone guide body 103, so that the cone guide body 103, the blocking portion 104 and the actuator 108 form a sealing cavity. The position detection sensor 105, the control circuit board 106, and the high temperature battery 107 are mounted in the sealing cavity. The high temperature battery 107 supplies power to the actuator 108 under the control of the control circuit board 106. An outer diameter of the sealing ring 102 in an un-expanded state is not greater than an overall outer diameter of the smart key label.

Figure 6:
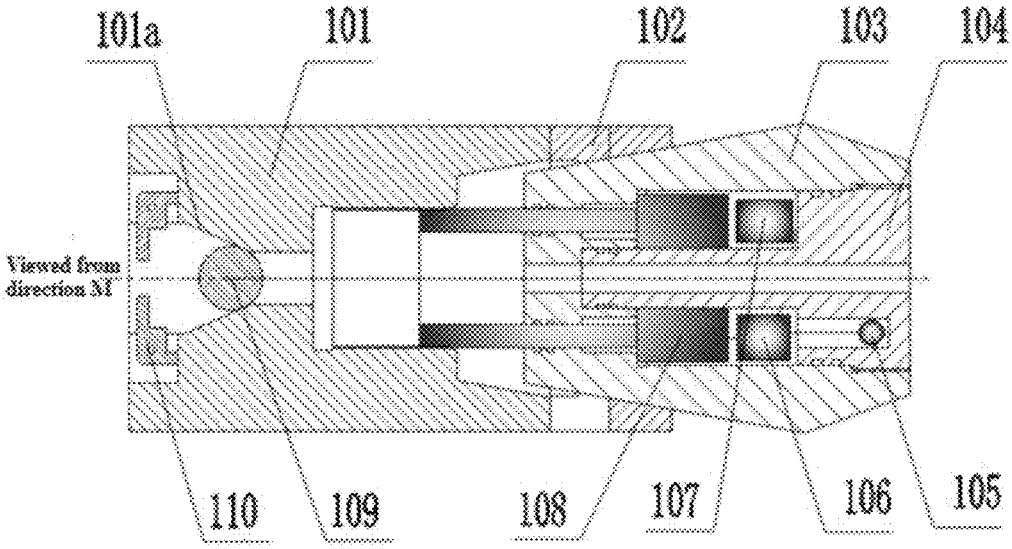
FIG. 6 is a structural diagram of a smart key label of Embodiment 2.
Figure 7:
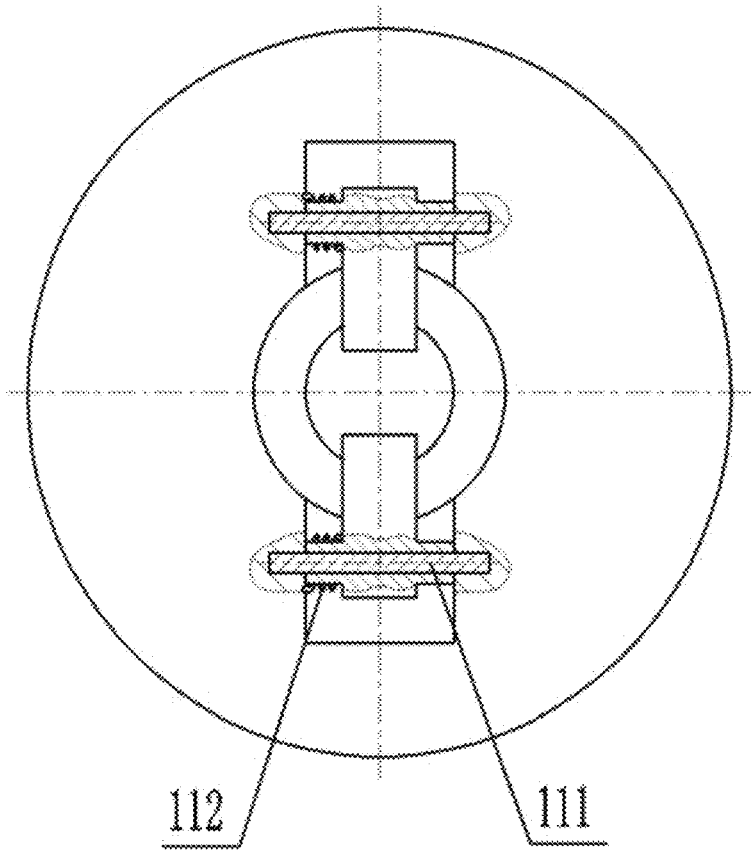
FIG. 7 is a schematic diagram of the smart key label viewed from a direction M.

Furthermore, as shown in FIG. 6, in order to ensure that the soluble ball 109 does not break away from the smart key label in the sliding push sleeve 101, the overturning pin 111 is mounted on an inner left side of the sliding push sleeve 101. The overturning stopper 110 is connected to a recess formed in a left end of the sliding push sleeve 101 through the overturning pin 111, and the torsion spring 112 is sleeved on the overturning pin 111. Spring wires at both ends of the torsion spring 112 are respectively fixed on the sliding push sleeve 101 and the overturning stopper 110. The torsion spring 112 is used to provide the torque of the overturning stopper 110 to ensure that the overturning stopper 110 is always in a blocking state without external force. In the blocking state, the overturning stopper 110 play a one-way role and can be turned freely to a certain angle counter-clockwise, so that the soluble ball 109 can be loaded into the sliding push sleeve 101. The overturning stopper 110 is limited by the sliding push sleeve 101 in the clockwise direction and cannot be turned over, thus preventing the soluble ball 109 from breaking away from the sliding push sleeve 101.

When the smart key label is in an initial state, the actuator 108 is in an extended state, and a first magnet 202 is used to form a magnetic field; when the smart key label passes by the first magnet 202, the position detection sensor 105 in the smart key label detects the magnetic field and thus determines the target sliding sleeve that the smart key label needs to control and open by counting. When the position detection sensor detects the target sliding sleeve, the high temperature battery 107 supplies power to the actuator 108 under the control of the control circuit board 106. After the actuator 108 is triggered, a pushing rod of the actuator 108 retracts. At this time, the cone guide body 103 moves relative to the sliding push sleeve 101 under the action of the retraction force of the actuator 108. A pushing force generated by the movement of the sliding push sleeve 101 acts on a left end surface of the sealing ring 102 to drive the sealing ring to move rightwards. The sealing ring 102 maintains in contact with the cone surface of the cone guide body 103, and the sealing ring 102 gradually expands until the outer diameter of the sealing ring 102 is greater than the outer diameter of the sliding push sleeve 101 and the maximum outer diameter of the cone guide body 103.

Figure 8:
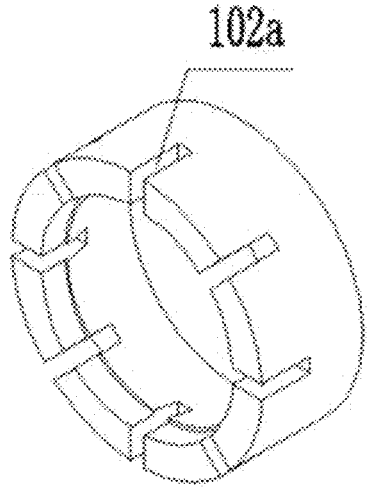
FIG. 8 is a structure diagram of a sealing ring of the smart key label.

In an embodiment, in order to avoid the situation that the sealing ring 102 is pumped to move forwards too fast and passes through the target sliding sleeve before expanding to the target outer diameter, and thus fails to be clamped in the target sliding sleeve which further causes the failure of the opening of the target sliding sleeve, at least one unloading slot 102*a* is evenly formed in the left end of the sealing ring 102 along a circumferential direction as shown in FIG. 8. The unloading slot 102*a* form an incomplete annular structure. When the sealing ring 102 moves rightwards along the cone guide body 103, due to the unloading slot 102*a*, the pushing force required for expanding the left end of the sealing ring 102 is far less than that required for expanding other parts of the sealing ring 102 which forms a complete first annular structure, so the sealing ring 102 can rapidly expand and is clamped in the sliding sleeve, which avoids the situation that the sealing ring passes through the sliding sleeve before expanding to the target degree.

In an embodiment, the system also includes a soluble ball 109. The smart key label has a flowback channel, that is, the sliding push sleeve 101 communicates with an axis of the blocking portion 104, the soluble ball 109 is arranged at a left end of the flowback channel to block the left part of the flowback channel, to play the role of a one-way check valve. When a pressure is applied to a left side of the flowback channel in the pumping and fracturing process, the soluble ball 109 can meet the sealing requirement; after the fracturing is completed, the soluble ball 109 can open the flowback channel when the pressure is applied to a right side of the flowback channel in the flowback process. This structure can allow the soluble ball 109 to be floated in the smart key label. During the pumping or fracturing process, the soluble ball 109 can be tightly attached to the left part of a center channel of the smart key label to realize the one-way sealing from wellhead to downhole. When the fracturing construction is completed and the formation fracturing fluid flows back, the soluble ball 109 no longer blocks the center channel of the smart key label under the action of formation pressure and thus forms a one-way communication from downhole to wellhead, which can freely switch between a fracturing state and a flowback state without any intervening process.

As shown in FIG. 6, the left end of the sliding push sleeve 101 is provided with a chamfer surface 101*a*, such that the soluble ball 109 can always be blocked in the left part of the flowback channel through the guidance of the chamfer surface 101*a* when the pressure is applied to the left side of the flowback channel.

The end sliding sleeve includes a first housing part which includes an upper casing connector 201, the first magnet 202, a first transition housing 203, a first sliding sleeve main housing 204, a first sliding valve 205, a lower casing connector 206, a first clamping pin 207, a first cutting pin 208 and a first sandblasting port 209. A first valve body part is arranged in the first housing part.

Figure 9:
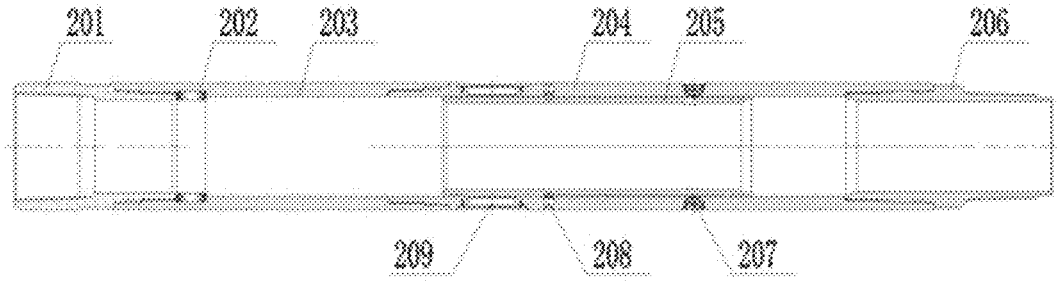
FIG. 9 is a structural diagram of an end sliding sleeve of Embodiment 1.

As shown in FIG. 9, each stage of the end sliding sleeve is connected through threads. The upper casing connector 201 is mounted on a left end of the first transition housing 203. A first annular groove is formed in one inner side of the first transition housing 203 adjacent to the upper casing connector 201, and the first magnet 202 is fixed in the first annular groove. The first sliding sleeve main housing 204 is mounted on a right end of the first transition housing 203. The lower casing connector 206 is mounted on a right side of the first sliding sleeve main housing 204. A protrusion extending inwards is formed on a right side of an inner wall of the first sliding valve 205. The protrusion is configured to clamp the expanded sealing ring 102 in the smart key label. The first sliding valve 205 is mounted in the first sliding sleeve main housing 204. The first clamping pin 207 is mounted on the first sliding sleeve main housing 204. The first cutting pin 208 and the first sandblasting port are all formed on the first sliding sleeve main housing 204, wherein the first cutting pin 208 is located on a right side of the first sandblasting port 209. A slot structure, that is a first outer diameter slot in which the first clamping pin 207 can be clamped is formed in an outer wall of the first sliding valve 205, and a mounting hole I in which the first cutting pin 208 can be clamped is formed in the first sliding valve 205. The first sliding valve 205 initially blocks the first sandblasting port 209 evenly distributed on the first sliding sleeve main housing 204 to close the first sandblasting port 209, that is, to close the end sliding sleeve. At this time, the first sliding valve 205 is fixed by the first cutting pin 208. The first clamping pin 207 is used to fix the first sliding valve 205 after the first sandblasting port 209 is opened, that is, after the end sliding sleeve is opened, which can prevent the end sliding sleeve from being closed again.

Figure 10:
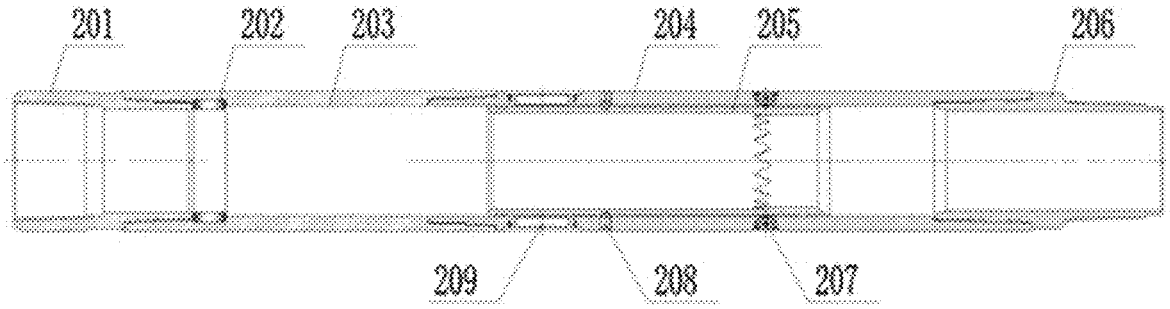
FIG. 10 is a schematic diagram of an end sliding sleeve of Embodiment 2.
Figure 11:
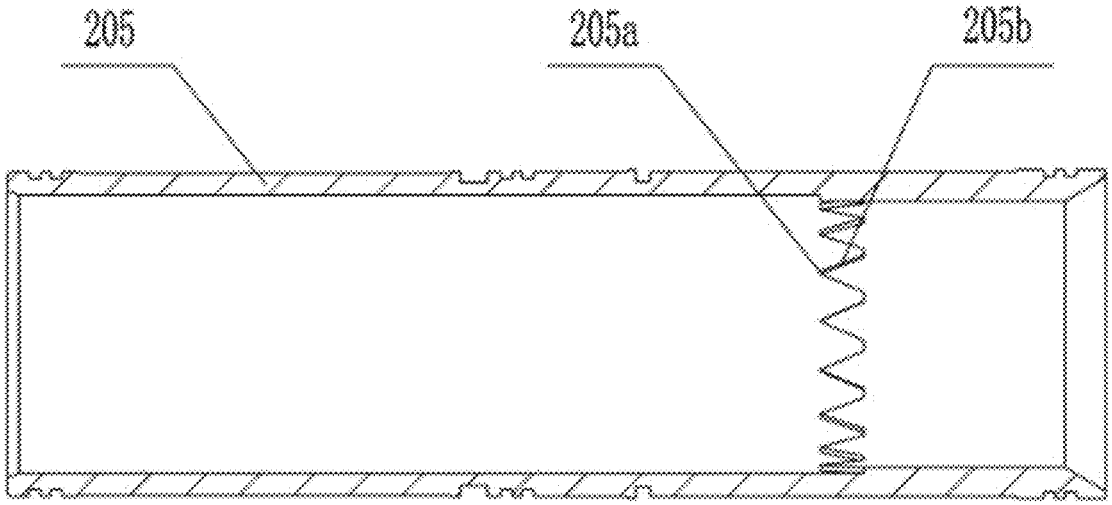
FIG. 11 is an amplified diagram of a first sliding valve in FIG. 10.

Further, as shown in FIGS. 10 and 11, in order to make the clamping between the end sliding sleeve and the smart key label more firm, a sawtooth structure is formed on a left end of the protrusion of the first sliding valve 205 in a circumferential direction, including a plurality of tooth tips 205*a* located on a left end thereof and a first sawtooth side 205*b* extending rightwards.

In an embodiment, after the sealing ring 102 in the smart key label expands, the tooth tips 205*a* contact an end surface of the sealing ring 102 at first. Since a pressure generated by each tooth tip 205*a* is greater than a yield strength of the material of the sealing ring 102, the tooth tips 205*a* can squeeze into the sealing ring 102 to be located between the end surface of the sealing ring 102 and the inner wall of the first sliding valve 205, forming a plurality of triangular grooves on the sealing ring 102 each which has the same profile as the tooth tip 205*a*. As the sawtooth tips 205*a* squeeze into the sealing ring 201 more deeply, the contact area between the first sawtooth side 205*b* and the sealing ring 102 gradually increases. Until the sawtooth structure squeeze into the sealing ring 102 in place, the first sliding valve 205 is completely clamped and sealed.

In an embodiment, each raised saw tooth is an isosceles triangle and two adjacent isosceles triangles is spaced to produce a shoulder with a plane on the left part thereof, increasing the degree to which the sealing ring 102 is attached to the protrusion in the direction of pumping pressure.

Similar to the structure of the end sliding sleeve, the multi-cluster sliding sleeve includes a second housing part and a second valve body part. In an embodiment, the second housing part can be integrally formed or separately formed. An annular groove is formed in an inner wall of the second housing part, and a clamping structure is arranged in the second valve body part to clamp the smart key label. The clamping structure can enter the annular groove to stop the clamping of the smart key label. There are two embodiments of the multi-cluster sliding sleeve as follows.

Embodiment 1

Figure 12:
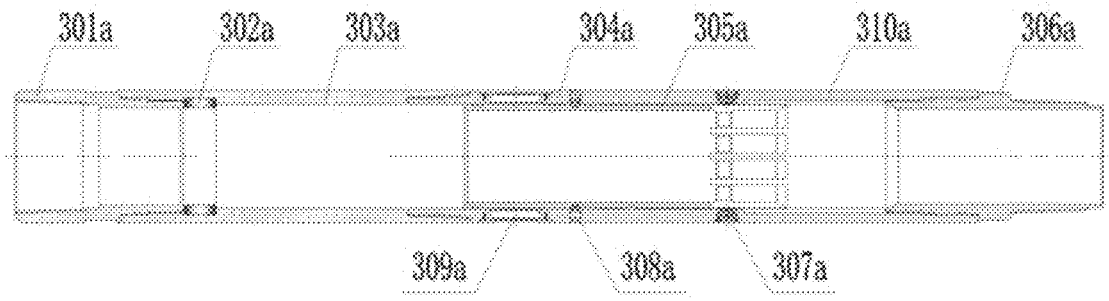
FIG. 12 is a schematic diagram of a multi-cluster sliding sleeve of Embodiment 1.
Figure 13:
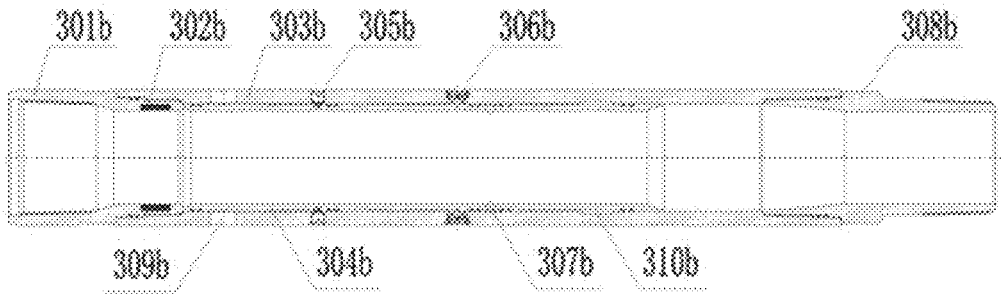
FIG. 13 is a schematic diagram of a multi-cluster sliding sleeve of Embodiment 2.
Figure 14:
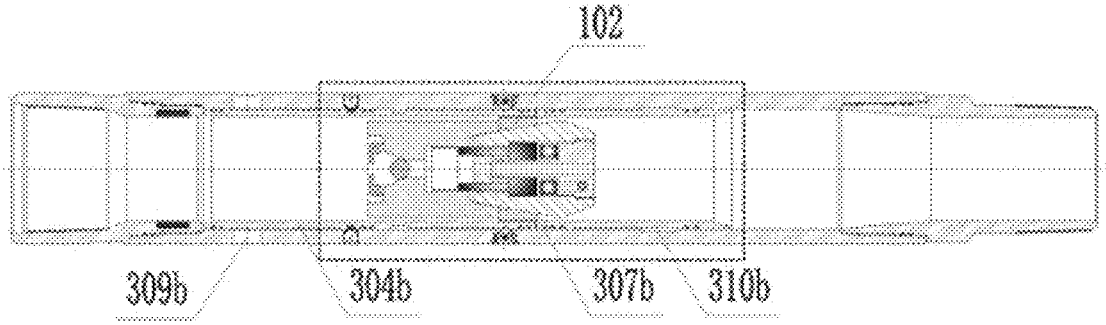
FIG. 14 is a schematic diagram showing the smart key label expands to be clamped at a position of a transmission pin of the multi-cluster sliding sleeve.
Figure 15:
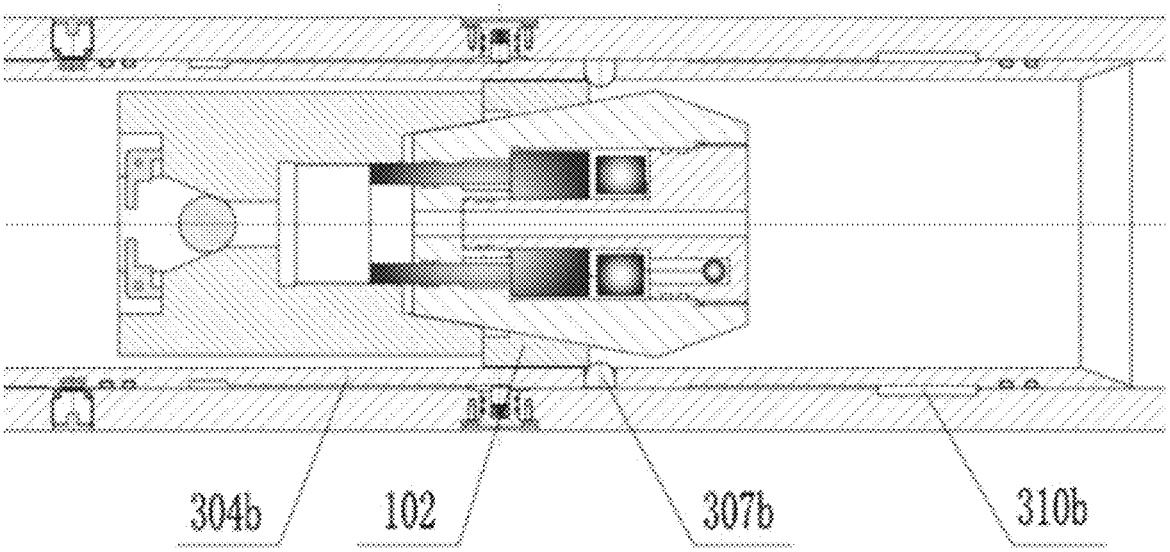
FIG. 15 is a sectionally-enlarged diagram of FIG. 14.
Figure 16:
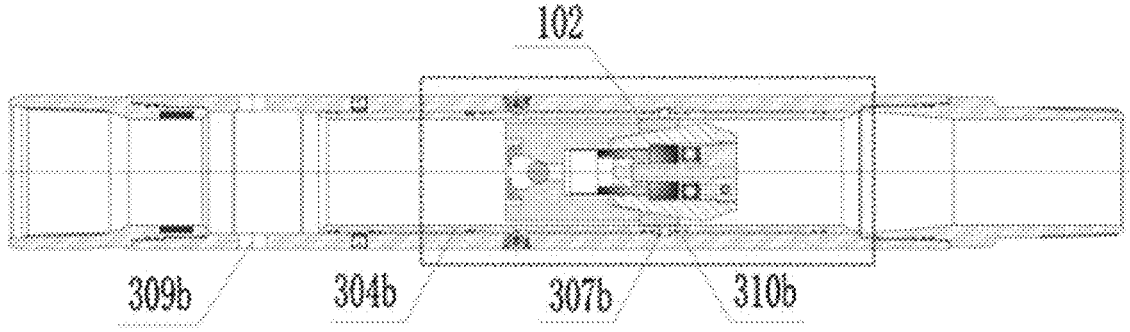
FIG. 16 is a schematic diagram showing the transmission pin retracting into an second annular groove after a second sandblasting port of the multi-cluster sliding sleeve is opened.
Figure 17:
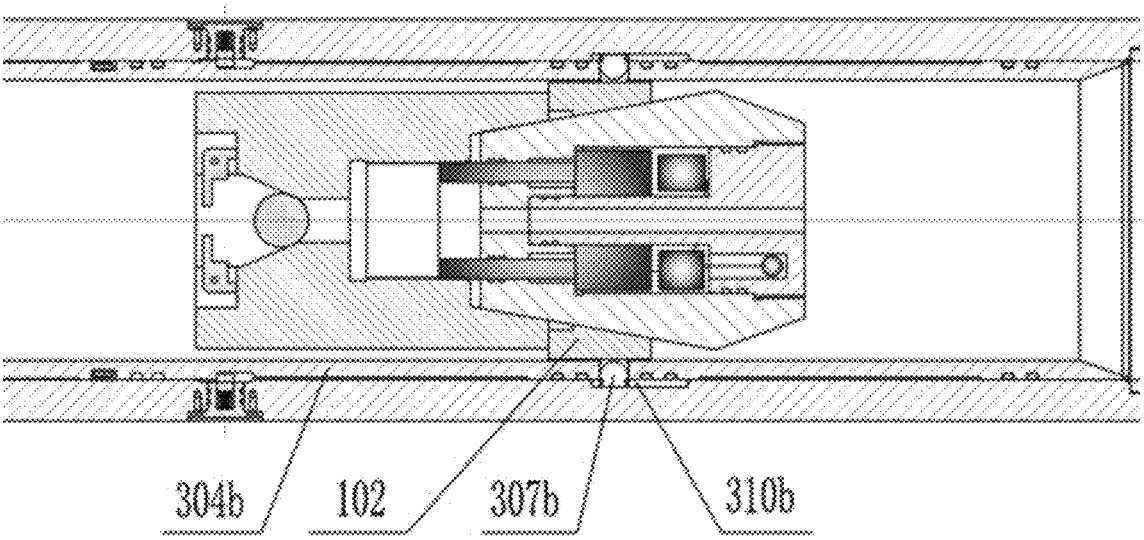
FIG. 17 is a sectionally-enlarged diagram of FIG. 16.

In the embodiment, as shown in FIG. 12, the second housing part includes a first upper connector 301*a*, a second magnet 302*a*, a second transition housing 303*a*, a second sliding sleeve main housing 304*a*, a first lower connector 306*a*, a second clamping pin 307*a*, a second cutting pin 308*a*, and a second sandblasting port 309*a*. Different from the end sliding sleeve, the second housing part further includes a first annular slot 310*a* and the second valve body part includes an expandable sliding valve 305*a*.

The first upper connector 301*a* is mounted on a left end of the second transition housing 303*a*. An second annular groove is formed in an internal side of the second transition housing 303*a* adjacent to the first upper connector 301*a*. The second magnet 302*a* is fixed in the second annular groove. The second sliding sleeve main housing 304*a* is mounted on a right end of the second transition housing 303*a*. The first lower connector 306*a* is mounted on a right side of the second transition housing 303*a*. At least one axial slot is evenly formed in a right end of the sliding valve 305*a* in a circumferential direction, and a right end of each axial slot forms an opening, so that the at least one axial slot can form a second incomplete annular structure, which is used as the clamping structure. The first annular slot 310*a* is formed in an internal right side of the second sliding sleeve main housing 304*a*. The expandable sliding valve 305*a* is mounted in the second sliding sleeve main housing 304*a*, and the second clamping pin 307*a* is mounted on the second sliding sleeve main housing 304*a*. A second outer diameter slot is formed in an outer wall of the expandable sliding valve 305*a* into which the second clamping pin can be clamped, and a second mounting hole is defined in an outer wall of the expandable sliding valve 305*a* into which the second cutting pin 308*a* can be clamped. The second cutting pin 308*a* and the second sandblasting port 309*a* are formed on the second sliding sleeve main housing 304*a*, and the second cutting pin 308*a* is located on a right side of the second sandblasting port 309*a*. The expandable sliding valve 305*a* can expand to close the second sandblasting port 309*a*; at this time the expandable sliding valve 305*a* is fixed through the second cutting pin 308*a*. The second clamping pin 307*a* is used, after the second sandblasting port 309*a* is opened, that is, after the multi-cluster sliding sleeve is opened, to fix the expandable sliding valve 305*a* to prevent the multi-cluster sliding sleeve from being closed again.

When the incomplete annular structure of the expandable sliding valve 305*a* reaches the first annular slot 310*a* formed in the second sliding sleeve main housing 304*a*, the first annular slot 310*a* can expand the incomplete annular structure outwards. When the multi-cluster sliding sleeve is in an initial state, the multi-cluster sliding sleeve is closed; at this time the expandable sliding valve 305*a* is at the position of the first annular slot 310*a* of the second sliding sleeve main housing 304*a*, thus, the expandable sliding valve 305*a* can not expand; when the smart key label pushes the expandable sliding valve 305*a* to move rightwards to the sliding sleeve in the opened state, the second incomplete annular structure of the expandable sliding valve 305*a* is at the position of the first annular slot 310*a* of the second sliding sleeve main housing 304*a*, the smart key label expands the second incomplete annular structure of the expandable sliding valve 305*a* under the action of pumping, the second incomplete annular structure expands into the first annular slot 310*a*, the smart key label passes through the multi-cluster sliding sleeve to enter and open the multi-cluster sliding sleeve of the next level until being clamped and blocked in the end sliding sleeve.

Embodiment 2

As shown from FIG. 13 to FIG. 17, the difference between the multi-cluster sliding sleeve in Embodiment 1 and the multi-cluster sliding sleeve in Embodiment 2 lies in that, the second transition housing 303*a* and the second sliding sleeve main housing 304*a* are replaced by a third integrally-formed sliding sleeve main housing 303*b*, the second incomplete annular structure is omitted, the transmission pin 307*b* is added, and the installation position of the second magnet 302*a* is different.

The second housing part of Embodiment 2 of the multi-cluster sliding sleeve includes a second upper connector 301*b*, a third magnet 302*b*, a third sliding sleeve main housing 303*b*, a third cutting pin 305*b*, a third clamping pin 306*b*, a second lower connector 308*b*, a third sandblasting port 309*b*, a second annular slot 310*b*, a second valve body part including a second sliding valve 304*b* and a transmission pin 307*b*.

The second upper connector 301*b* is mounted on a left part of the third sliding sleeve main housing 303*b*. third annular groove is formed in an internal left side of the second upper connector 301*b*, and the third magnet 302*b* is fixed in the second annular groove. The second lower connector 308*b* is mounted on a right part of in the third sliding sleeve main housing 303*b*, the second sliding valve 304*b* is mounted in the third sliding sleeve main housing 303*b*, and the third cutting pin 305*b* is mounted on an outer wall of the third sliding sleeve main housing 303*b*. A third mounting hole is defined in an outer wall of the second sliding valve 304*b* into which the third cutting pin 305*b* can be inserted to fix the second sliding valve 304*b* in an initial position. The third sandblasting port 309*b* is distributed in a circumferential direction and is formed in a side of the third sliding sleeve main housing 303*b* adjacent to the second upper connector 301*b*. The third clamping pin 306*b* is mounted on the third sliding sleeve main housing 303*b*, and a third outer diameter slot is formed in an outer wall of the second sliding valve 304*b*, so that after the third sandblasting port 309*b* is opened, the third clamping pin 306*b* is clamped into the third outer diameter slot to fix the second sliding valve 304*b*, preventing the multi-cluster sliding sleeve from being closed again. The second annular slot 310*b* is formed in a right side of the inner wall of the third sliding sleeve main housing 303*b*.

Furthermore, when the multi-cluster sliding sleeve is in the initial state, the second sliding valve 304*b* blocks the third sandblasting port 309*b*, and the multi-cluster sliding sleeve is in the closed state. The third cutting pin 305*b* is inserted into the third mounting hole of the second sliding valve 304*b*. The transmission pin 307*b* is a cylindrical structure with a convex ball head, that is, an inner end of the transmission pin 307*b* is a ball structure. The cylindrical structure with the convex ball head is the clamping structure being mounted in the second sliding valve 304*b*. The ball structure of the transmission pin 307*b* is located on an inner side of an inner wall of the second sliding valve 304*b*, that is, the ball structure extends out of the inner wall of the second sliding valve 304*b*; at this time, the channel size of the second sliding valve 304*b* allows the smart key label in the initial state to pass therethrough, that is, when the current multi-cluster sliding sleeve is not the target open sliding sleeve, the smart key label can pass the current multi-cluster sliding sleeve normally to the next sliding sleeve. The transmission pin 307*b* not only ensures the reliable locking before the opening of the multi-cluster sliding sleeve, but also allows the smart key label to pass through the multi-cluster sliding sleeve after the multi-cluster sliding sleeve is opened, as well as effectively avoids the risk that the conventional label or ball can not pass through the current multi-cluster sliding sleeve due to the cement consolidation in the inner wall of the multi-cluster sliding sleeve in the early stage of the cementing process.

Furthermore, when the smart key label detects that the current multi-cluster sliding sleeve is the target open sliding sleeve, the smart key label is triggered and the sealing ring 102 expands. After the sealing ring 102 expands, the outer diameter of the smart key label is greater than the diameter of the channel formed by the transmission pin 307*b* arranged in the second sliding valve 304*b* which are evenly distributed in the annular direction, so that the smart key label is clamped in the second sliding valve 304*b*. As the pressure from a ground pump vehicle increases, the third cutting pin 305*b* is broken, and the smart key label pushes the second sliding valve 304*b* to move rightwards to expose the third sandblasting port 309*b*, thus opening the sliding sleeve.

When the second sliding valve 304*b* is opened in place, the position of the transmission pin 307*b* coincides with that of the second annular slot 310*b* in the inner wall of the third sliding sleeve main housing 303*b*. Under the pumping pressure, the smart key label continues to move rightwards. At this time, the inner wall of the third sliding sleeve main housing 303*b* stops clamping the outer end of the transmission pin 307*b*, and thus the transmission pin 307*b* retracts into the second annular slot 310*b*; the diameter of the sliding sleeve is then greater than the outer diameter of the expanded sealing ring of the smart key label, the smart key label is removed from the current multi-cluster sliding sleeve and enters the next multi-cluster sliding sleeve, and so on. All the multi-cluster sliding sleeves before the end sliding sleeve are opened in turn, until the smart key label is clamped in the end sliding sleeve.

The multi-cluster sliding sleeve includes a plurality of the transmission pins 307*b* and the transmission pins 307*b* are set to have the ball structure, thus, when one of the transmission pin 307*b* can not retract into the second annular slot 310*b*, the smart key label can still be removed from the sliding sleeve rather than being stuck in the sliding sleeve. This is because, as the pumping pressure increases, since the contact area between the invalid transmission pin 307*b* and the smart key label is small and is a curved surface, the smart key label can squeeze through the invalid transmission pin 307*b*, to avoid the smart key label from being stuck in the second sliding valve 304*b*. In an embodiment, the number of the transmission pin 307*b* can be at least 4 to 8.

Furthermore, the transmission pin 307*b* which cannot retract may scratch the surface of the sealing ring 102, resulting in scratches on the surface of the sealing ring 102 and thus affecting the sealing effect when the smart key label is clamped in the end sliding sleeve. Therefore, in an embodiment, a width of each saw tooth in the shape of isosceles triangle on the protrusion of the end sliding sleeve needs to be greater than a diameter of the convex ball head of the transmission pin 307*b*, that is, when the sealing ring 102 opens the previous multiple multi-cluster sliding sleeves, a width of a groove on the surface of the sealing ring 102 generated by each scratch caused by the transmission pin 307*b* is less than a length of the bottom edge of the isosceles triangle on the sawtooth structure. The first sawtooth side 205*b* can block an edge end of the groove on the sealing ring 102 generated by the transmission pin 307*b* to ensure the sealing reliability. The size and interval of the transmission pin 307*b* should correspond to the sawtooth structure, which means that the tooth tips 205*a* can guide the groove generated by the invalid transmission pin 307*b* on the sealing ring 102 to ensure that the first sawtooth side 205*b* can squeeze into the groove. In this way, after opening the multi-cluster sliding sleeves through the smart key label, even if the sealing ring is damaged, the sealing ring can reliably be clamped and block the center channel of the end sliding sleeve to ensure the fracturing construction.

Figure 2:
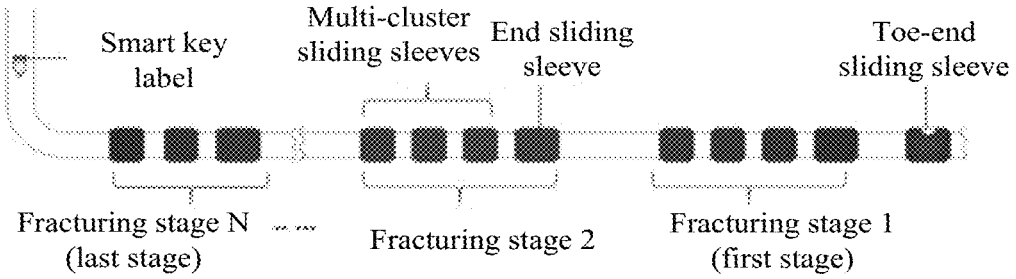
FIG. 2 is a schematic diagram of a process pipe string of the staged multi-cluster fracturing sliding sleeve system based on smart key label.
Figure 3:
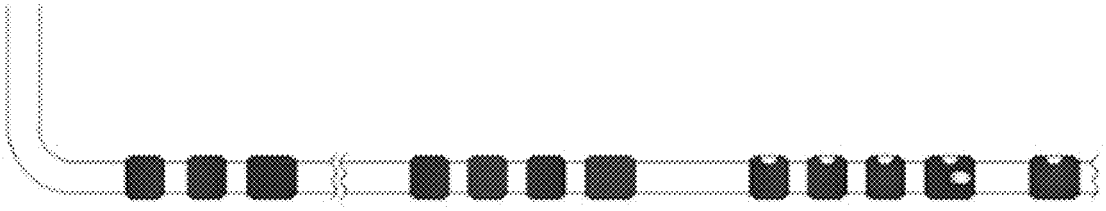
FIG. 3 is a schematic diagram of the sliding sleeve of a first stage in an opened state.
Figure 4:
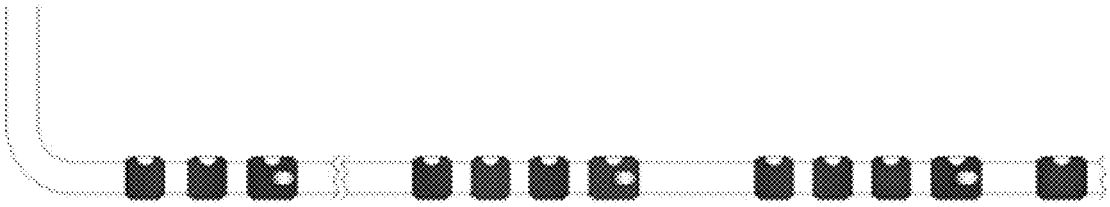
FIG. 4 is a schematic diagram showing that the sliding sleeves from the first stage to a last stage are all in the opened state.
Figure 5:
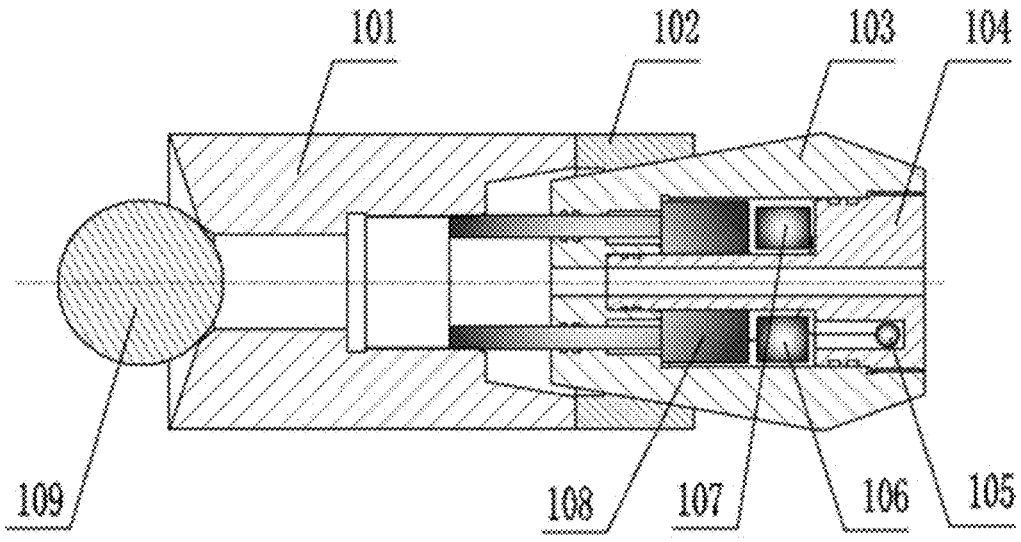
FIG. 5 is a structural diagram of a smart key label of Embodiment 1.

The implementation method of the above system, as shown in FIGS. 2 to 4, which shows the state of the sliding sleeves of different fracturing stages after being opened, wherein several multi-cluster sliding sleeves are correspondingly placed in each fracturing stage, and an end sliding sleeve is placed at the end of the fracturing stage. When fracturing construction is required, the fracturing stages are fractured from bottom to up and from the first stage to the last stage. As shown in FIG. 2, a smart key label is placed through a wellhead and is pumped to the target fracturing stage. The smart key label opens the multi-cluster sliding sleeves and the end sliding sleeve in the current fracturing stage one by one, and finally is sealed in the end sliding sleeve of the current fracturing stage. At this time, the opening of all sliding sleeves in the current fracturing stage is completed. The subsequent fracturing construction then can be performed. Similarly, a smart key label is placed through the wellhead to control the opening of each fracturing stage, until all fracturing stages are completed.

Furthermore, after the smart key label is placed into the well, the smart key label can continuously detect the magnet in the sliding sleeve through the position detection sensor 105, such as the first magnet, the second magnet and the third magnet. Each time after the magnet is detected, the count increments by 1; when the count reaches the ground preset number of the target open stage, the clamping and seating operation is performed.

Figure 18:
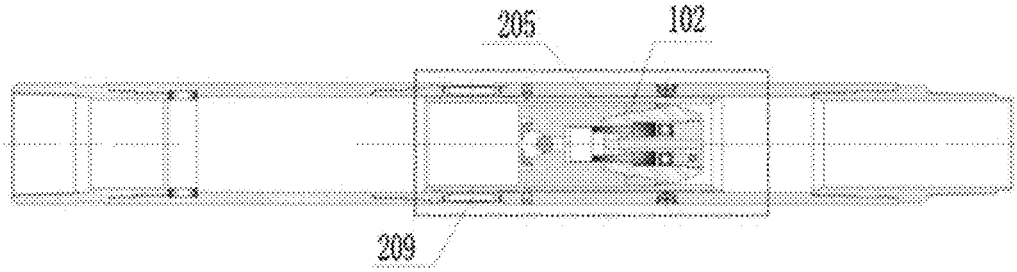
FIG. 18 is a schematic diagram showing the engagement between the smart key label and the protrusion in in the end sliding sleeve.
Figure 19:
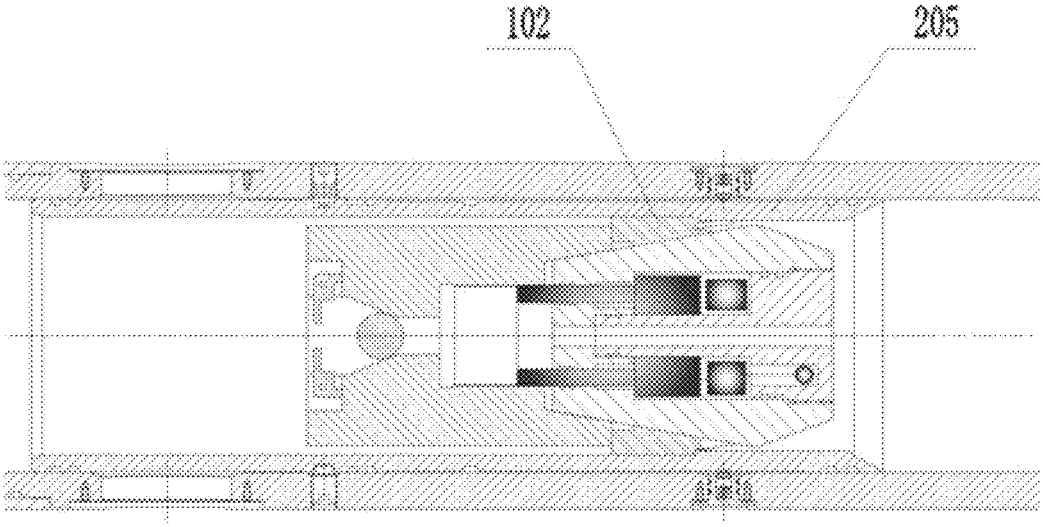
FIG. 19 is a sectionally-enlarged view of FIG. 18.

Combined with FIG. 9 and FIG. 18, the sealing ring 102 is in the expanded state and is pumped forwards continuously until contacting the protrusion in the inner hole of the first sliding sleeve sliding valve 205. At this time, under the action of the pump truck, the pressure applied to the left side of the smart key label gradually increases, and the pushing force generated by the pressure difference between both ends of the smart key label acts on the first sliding valve 205. When the pushing force reaches a cutting force of the first cutting pin 208, the first cutting pin 208 is broken, and the first sliding valve 205 moves rightwards under the pushing force from the smart key label to open the end sliding sleeve.

Figure 20:
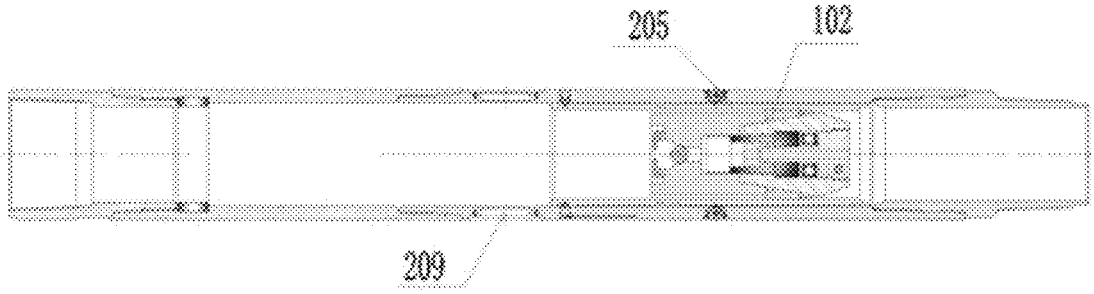
FIG. 20 is a structural diagram showing that the smart key label opens the first sandblasting port in the end sliding sleeve.
Figure 21:
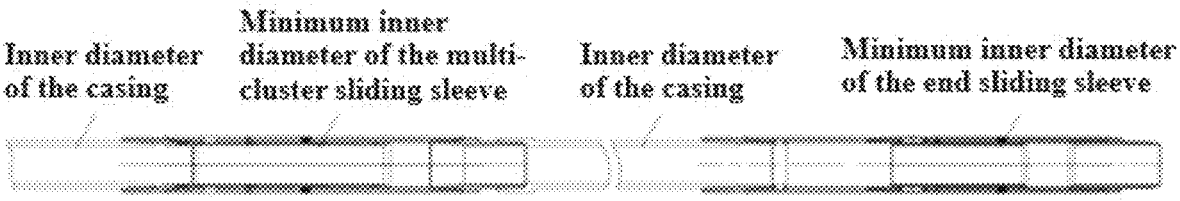
FIG. 21 is a schematic diagram showing that the multi-cluster sliding sleeve, the end sliding sleeve and a casing are in a full-bore state.

As shown in FIG. 9 and FIG. 20, with the pressure from the pump truck at the wellhead increases, the first sliding valve 205 continues to move rightwards until the end sliding sleeve is opened in place. At this time, the clamping pin 207 is stuck into the first outer diameter slot of the first sliding valve 205 under the action of the spring to locking the first sliding valve 205 after the sliding sleeve is opened and avoid the first sliding valve 205 from restoring to its original position and closing the sliding sleeve. The opening principle of the multi-cluster sliding sleeve is the same as that of the end sliding sleeve, including the use of the sliding valve, the clamping pin, the cutting pin and the sandblasting port in the sliding sleeve. After the sliding sleeve, that is, the multi-cluster sliding sleeve and the end sliding sleeve are opened, the pump truck continues to pressurize and the fracturing construction begins until the fracturing of the current fracturing stage is completed.

The smart key label is made of soluble material; when the fracturing of each stage of the whole well is completed, the smart key label can be completely dissolved in a certain period of time under the immersion of fracturing fluid containing salt solution to restore the inner channel of the sliding sleeve. The implementation process is thus over.

It is understandable that the above-mentioned technical features may be used in any combination without limitation. The above descriptions are only the embodiments of the present disclosure, which do not limit the scope of the present disclosure. Any equivalent structure or equivalent process transformation made by using the content of the description and drawings of the present disclosure, or directly or indirectly applied to other related technologies in the same way, all fields are included in the scope of patent protection of the present disclosure.

What is claimed is:

1. A smart key label, wherein the smart key label comprises a sliding push sleeve (101), a cone guide body (103) connected with the sliding push sleeve (101) through an actuator (108), a sealing ring (102) mounted on a right end of the sliding push sleeve (101), and an inner end surface of the sealing ring (102) is attached to an outer end surface of the cone guide body (103); the actuator (108) is connected with the sliding push sleeve (101) through a thread, and a blocking portion (104) is connected to an internal right end of the cone guide body (103); the cone guide body (103), the blocking portion (104) and the actuator (108) form a sealing cavity; a position detection sensor (105), a control circuit board (106) and a high temperature battery (107) are arranged in the sealing cavity and are connected by a wire; the actuator (108) is capable of driving the sliding push sleeve (101) to move relative to the cone guide body (103); the sliding push sleeve (101) drives the sealing ring (102) to move relative to the cone guide body (103) to expand or contract the sealing ring (102);

a flowback channel is formed in a left part of the sliding push sleeve (101), and a soluble ball (109) is arranged on one end of the flowback channel, which is capable of blocking a part nearing the end of the flowback channel.

2. The smart key label according to claim 1, wherein an outer diameter of the sealing ring (102) in the minimum state is not greater than an overall outer diameter of the smart key label.

3. The smart key label according to claim 1, wherein a left end of the sliding push sleeve (101) is provided with a chamfer surface being connected with the flowback channel.

4. A staged multi-cluster fracturing sliding sleeve system based on the smart key label of claim 1, wherein the stage multi-cluster fracturing sliding sleeve system comprises at least one multi-cluster sliding correspondingly placed in each fracturing stage, an end sliding sleeve placed at an end of the fracturing stage, and a smart key label which is pumped to a target fracturing stage.

5. The staged multi-cluster fracturing sliding sleeve system according to claim 4, wherein the multi-cluster sliding sleeve comprises a first housing part with a first magnetic field formed therein, and a first valve body part, and an annular slot formed in an inner wall of the first housing part, the first housing part being integrally formed or separately formed, and the position detection sensor (105) being capable of detecting the first magnetic field;

wherein the first valve body part is provided with a clamping structure for clamping the sealing ring (102).

6. The staged multi-cluster fracturing sliding sleeve system according to claim 5, wherein the clamping structure is a transmission pin (307*b*), and the transmission pin (307*b*) is a cylindrical structure with a convex ball head.

7. The staged multi-cluster fracturing sliding sleeve system according to claim 6, wherein a plurality of the transmission pins (307*b*) are evenly arranged along a circumferential direction.

8. The staged multi-cluster fracturing sliding sleeve system according to claim 6, wherein the end sliding sleeve comprises a second housing part with a second magnetic field formed therein, and the position detection sensor (105) being capable of detecting the second magnetic field;

wherein the end sliding sleeve further comprises a second valve body part, and a right side of the second valve body part is provided with a protrusion clamping with the sealing ring (102); and a left part of the protrusion is a sawtooth structure arranged along a circumferential direction.

9. The staged multi-cluster fracturing sliding sleeve system according to claim 7, wherein the end sliding sleeve comprises a second housing part with a second magnetic field formed therein, and the position detection sensor (105) being capable of detecting the second magnetic field;

wherein the end sliding sleeve further comprises a second valve body part, and a right side of the second valve body part is provided with a protrusion clamping with the sealing ring (102); and a left part of the protrusion is a sawtooth structure arranged along a circumferential direction.

10. An implementation method of the staged multi-cluster fracturing sliding sleeve system based on smart key label according to claim 9, comprising:

step S1, performing fracturing stage by stage from a first stage to a last stage, placing the smart key label through a wellhead and pumping the smart key label to the target fracturing stage;

step S2, opening the multi-cluster sliding sleeves of the current fracturing stage one by one through the smart key label, and finally blocking the smart key label in the end sliding sleeve when the multi-cluster sliding sleeve and the end sliding sleeve of the current fracturing stage are opened; and step S3, repeating the steps S1 and S2 until the fracturing operations of all the stages are completed.

* * * * *